United States Patent [19]

Willigman

[11] Patent Number: 4,755,635

[45] Date of Patent: Jul. 5, 1988

[54] ELECTRICAL PROGRAMMER

[75] Inventor: John Willigman, Elk Grove Village, Ill.

[73] Assignee: Eaton Corporation, Cleveland, Ohio

[21] Appl. No.: 55,384

[22] Filed: May 29, 1987

[51] Int. Cl.[4] ..... H01H 7/00; H01H 43/00

[52] U.S. Cl. ..... 200/35 R; 200/38 R; 200/38 B

[58] Field of Search ..... 200/35 R, 38 R, 38 A, 200/38 F, 38 B, 38 BA, 38 C, 38 CA, 38 D, 39 R, 153 LB, 153 P, 153 V

[56] References Cited

U.S. PATENT DOCUMENTS

| | | | |
|---|---|---|---|
| 4,500,212 | 2/1985 | Wojtanek | 200/38 B X |
| 4,523,062 | 6/1985 | Mahon | 200/35 R |
| 4,536,626 | 8/1985 | Wojtanek | 200/35 R |
| 4,577,179 | 3/1986 | Chambers et al. | 200/35 R X |
| 4,599,499 | 7/1986 | Duve | 200/35 R |

*Primary Examiner*—J. R. Scott
*Attorney, Agent, or Firm*—R. A. Johnston

[57] ABSTRACT

A electrical programmer (10, 120) is provided that features a first gear (18) that is rotated at a uniform rate by a drive source (16) and operative to rotate a driven gear (30) and an intermediate member (20) which, in turn, respectively operate to rotate a second cam (38) uniformally and a first cam (52) intermittently to open and close a first switch as a function of its uniform rotation; and, cam (52) is operative to open and close a second switch as a function of its intermittent rotation. Programmer (10, 120) preferably includes a rotary drum (110) operable to engage a plurality of electrical contacts in conjunction with the operation of the first and second sub-interval switches.

9 Claims, 3 Drawing Sheets

ELECTRICAL PROGRAMMER

INTRODUCTION

This invention relates generally to an electrical programmer/timer operable to program sequential making and breaking of a plurality of electrical function switches in response to rotation of a cam drum by a timing motor drive such as employed in programmer/-timers for appliances and the like; and, more particularly relates to such mechanisms having sub-interval switches in addition to switches operated by the main cam drum.

BACKGROUND OF THE INVENTION

In designing programmer/timers for appliances, it is known to provide rotary cams to program making and breaking of a plurality of pairs of electrical contacts at sub-intervals of the interval of rotation of the main program cam drum. In particular, it is also known to provide intermittent rotation of a cam drum by indexing a ratchet wheel connected to the cam with an oscillating drive pawl. The pawl is driven by an intermittent movement mechanism such as a Geneva movement employed to provide rapid advance of the ratchet followed by a dwell.

Heretofore, in mechanisms for providing intermittent rapid advance of the main program cam drum, sub-interval switching has been accomplished by secondary cams which rotate with the Geneva wheel or with an eccentric which oscillates the main drive pawl for driving the ratchet wheel. An example of the former is described in U.S. Pat. No. 4,599,499; and, an example of the latter is described in U.S. Pat. No. 4,577,179. Where the main cam drum indexing ratchet is driven by an intermittent drive mechanism, such as a Geneva mechanism, a sub-interval cam driven by the Geneva mechanism will also be subject to intermittent operation, and thus subject to severe limitation in the range of sub-interval switching which may be provided.

SUMMARY OF THE INVENTION

The present invention overcomes the above-described deficiency and adds an additional degree of freedom in the programming of the switches by providing a first sub-interval switch intermittently driven by a cam on the Geneva mechanism and a second sub-interval switch which is operated by a constantly rotating cam connected to the common drive source.

The present invention employs a motor driven pinion which has a first cam thereon for continuous rotation therewith and a first cam follower for actuating a first sub-interval switch. The pinion drives a Geneva mechanism having a second cam thereon for intermittently advancing a drive pawl for advancing a main cam ratchet. The driven wheel member of the Geneva mechanism also has a third cam thereon for intermittently operating a follower connected to actuate a second sub-interval switch.

The present invention thus provides a much broader range of combination of sub-interval switching than heretofore obtainable.

Accordingly, it is an object of this invention to provide a rotary driven programmer/timer switch mechanism having a plurality of switches operated by a ratchet indexed cam drum and having intermittent and continuously rotating cams programming operation of a plurality of electrical sub-interval switches.

It is another object of this invention to provide a rotary driven programmer/timer switch mechanism having a rotary cam member operable to constantly drive a cam for making and breaking one sub-interval switch and operable to intermittently drive another rotary cam operable to make and break another sub-interval switch.

DETAILED DESCRIPTION

Figure 1:
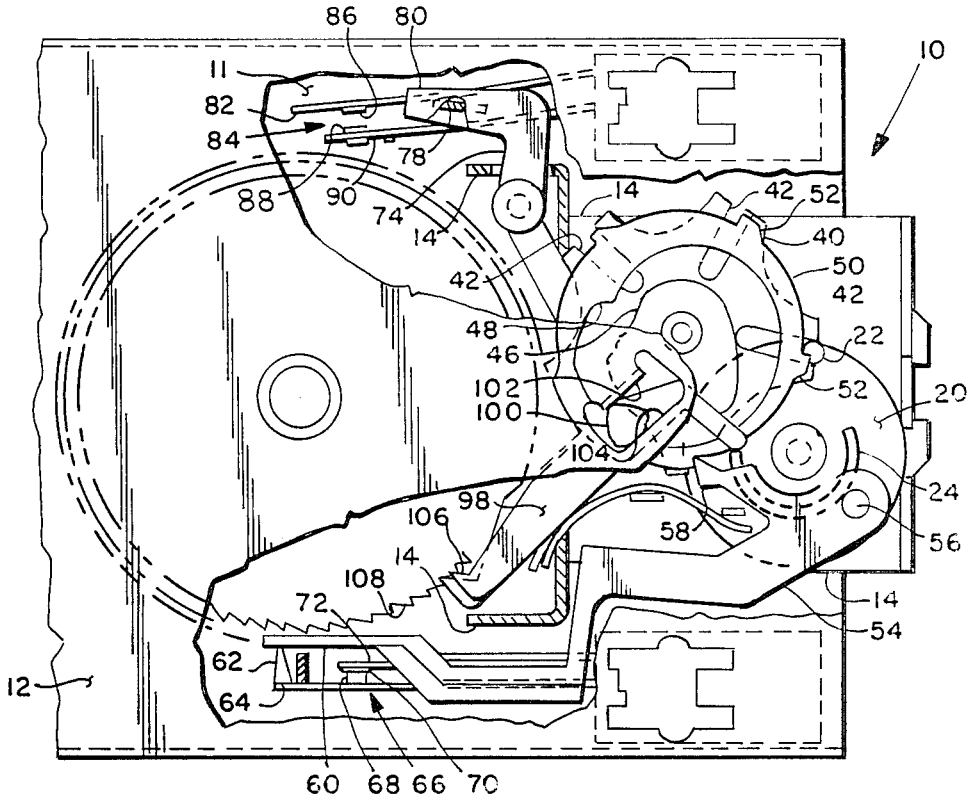
FIG. 1 is a side elevation view of one embodiment of the invention with the front mounting plate broken away to expose a first sub-interval switch and follower operated by a continuously moving cam and a second sub-interval switch and follower operated by an intermittently moving cam.
Figure 2:
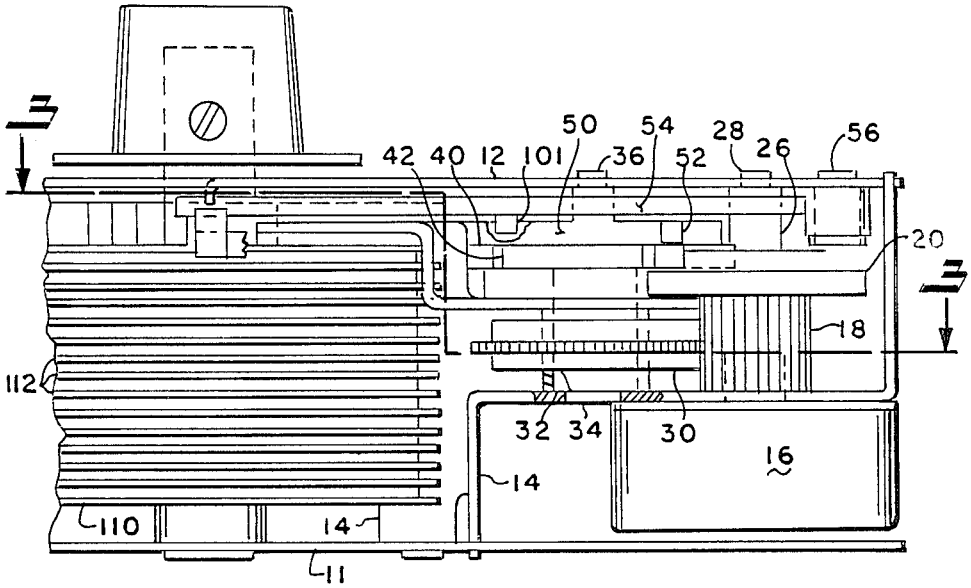
FIG. 2 is a bottom view of the embodiment of FIG. 1.

Referring to FIGS. 1 and 2, one embodiment of the invention is indicated generally at 10 as having a frame comprising a front mounting plate 12 and a rear mounting plate 11 disposed and interconnected by a sub-frame 14 in spaced parallel relationship. A suitable timing motor with speed reducer formed integrally therewith denoted 16 is mounted to sub-frame and has the output shaft thereof extending through the sub-frame 14 to drive a primary gear means in the form of pinion 18. Pinion 18 has preferably integrally formed therewith a wheel or disc 20 which has, on the axial face thereof opposite the pinion 18, a drive member or lug 22; and, spaced peripherally opposite from the disc 20 is an arcuately shaped cam track 24, which comprises a sub-interval cam as will hereinafter be described in greater detail. The end of disc 20 opposite pinion 18 has a shaft portion 26 which is journalled for rotation through the frame plate 12 as indicated by the small diameter stub shaft 28 provided thereon. The pinion 18, disc 20, shaft 26 and stub shaft 28 are preferably formed integrally of suitable plastic material.

Disposed in spaced relationship to pinion 18 is a secondary gear wheel 30 having teeth thereon in driving engagement with the pinion 18. Gear wheel 30 is journalled about a shaft 32 which has the end 34 thereof journalled for rotation in sub-frame 14 with the opposite end 36 thereof reduced in diameter and journalled for rotation through the frame plate 12. The secondary gear wheel 30 has provided on the face thereof adjacent sub-frame 14 a second sub-interval cam track 38 (see FIG. 3) which is preferably divided into two arcuate segments spaced diametrically opposite about the wheel.

A lost motion device preferably in the form of a Geneva wheel 40 having a plurality of circumferentially spaced radially extending open slots 42 is journalled coaxially with gear wheel 30 for free rotation thereabout. The slots 42 in the Geneva wheel 40 are disposed to intermittently engage a lug or post 44 disposed on the primary gear wheel disc 20 adjacent the periphery thereof. Geneva wheel 40 has provided on the face thereof opposite the slots 42 a pair of oppositely disposed recessed cam tracks comprising the the walls 46, 48 which cam tracks are operative for main program cam advancement as will hereinafter be described.

In the embodiment of FIG. 1, the Geneva wheel 40 also has provided about the periphery thereof, a peripheral cam track 50 comprising a plurality of circumferentially spaced lobes 52 which comprise a second sub-interval cam which is advanced in intermittent motion with Geneva wheel 40. In the presently preferred practice of the invention, the Geneva wheel 40, cam tracks 46, 48 and the peripheral cam 50 and reduced diameter portions thereof 34, 36 are integrally molded with shaft 32.

Referring to FIG. 1, a first sub-interval lever 54 is pivoted about post 56 attached to mounting frame plate 12 and lever 54 has integrally formed therewith an arm 58 which follows the cam track 50 on Geneva wheel 40. Lever 54 also has a main arm portion 60 disposed to act against a lift tab 62 provided on one blade 64 of a first sub-interval switch indicated generally at 66 having one the electrical contact 68 attached to blade 64 and the other contact thereof 70, attached to a second blade member 72. It will be understood that the blades 64, 72 of switch 66 may be cantilevered from a mounting block attached to mounting frame plate 11 in any suitable manner well known in the art.

Figure 3:
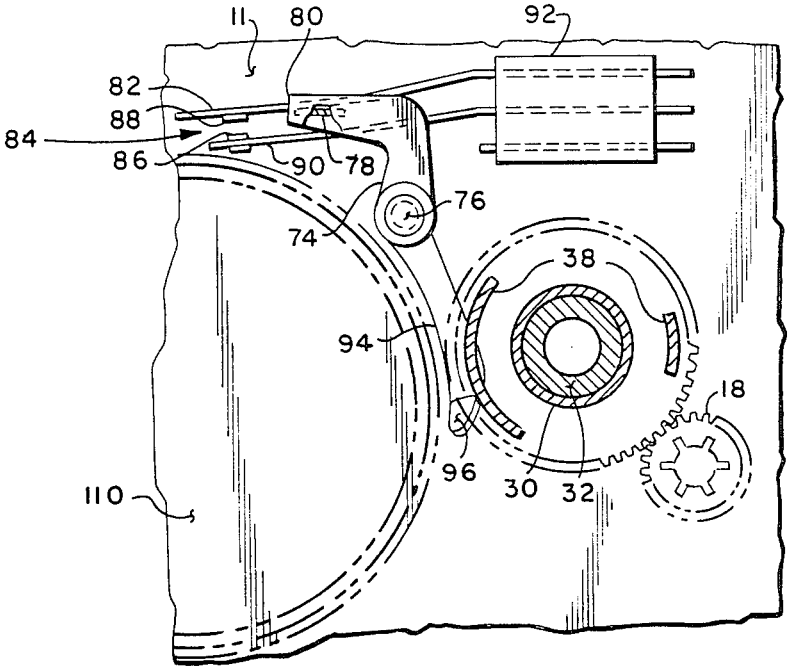
FIG. 3 is a section view taken along section lines 3—3 of FIG. 2 intermittent driven member shown in FIG. 1.

Referring to FIGS. 1 and 3, a second sub-interval switch lever 74 is pivotally mounted about a post 76 attached to mounting frame plate 12 and lever 74 has a depending tab 78 extending downwardly from the arm portion 80 of lever 74, which tab is disposed to effect movement of one blade arm 82 of a second sub-interval switch indicated generally at 84. Switch 84 has an electrical contact 86 mounted on blade 82 and a second electrical contact 88 mounted on a second movable blade 90. It will be understood that the blade arms 82, 90 of switch 84 may be mounted in cantilever from a switch mounting block 92 is provided on the mounting frame in any suitable manner as is well known in the art. Lever 74 has a second 94 thereof extending in a direction opposite of the arm 80; and, arm 94 has a lug 96 provided adjacent the end thereof, which lug serves as a follower against the second sub-interval cam track 38.

Referring to FIG. 1, a main or program drive pawl 98 is slidably mounted against the undersurface of mounting frame plate 12 by a lug 100 provided thereon which slides against a downwardly depending tab 102 formed in a cutout 104 provided in the mount frame plate 12. Pawl 98 has provided thereon the opposite side of lug 100 a suitable lug 101 which extends into the groove formed in Geneva wheel 40 and the lug 101 serves as a cam follower trapped between the cam tracks 46, 48. It will be understood that the cam follower lug 101 is hidden from view in FIG. 1 and is shown in the broken away portion in FIG. 2.

Pawl 98 has a suitable chisel point 106 which engages ratchet teeth 108 provided on the periphery of main program cam drum 110 which has a plurality of cam tracks 112 provided thereabout for actuating individual program function switches (not shown) as is well known in the art. The intermittent oscillation of pawl 98 thus imparts a step-by-step advancement of the cam drum 110 with a desired dwell time between each step for advancing the cam drum one full revolution in a desired program interval. The cam tracks 112 are designed to actuate the program function switches (not shown) in accordance with a desired sequence of program events as is well known in the art.

As primary gear wheel 20 rotates, cam track 50 on the Geneva wheel and lugs 52 intermittently effect downward motion to lever 54 for actuating or de-actuating first sub-interval switch 66 in accordance with a desired sub-interval sequence. Simultaneously, rotation of the secondary gear wheel 30 causes cam tracks 38 (see FIG. 3) to effect continuous cyclic movement of lever 74 and thereby cause the desired continuous actuation and deactuation of second sub-interval switch 84.

Figure 6:
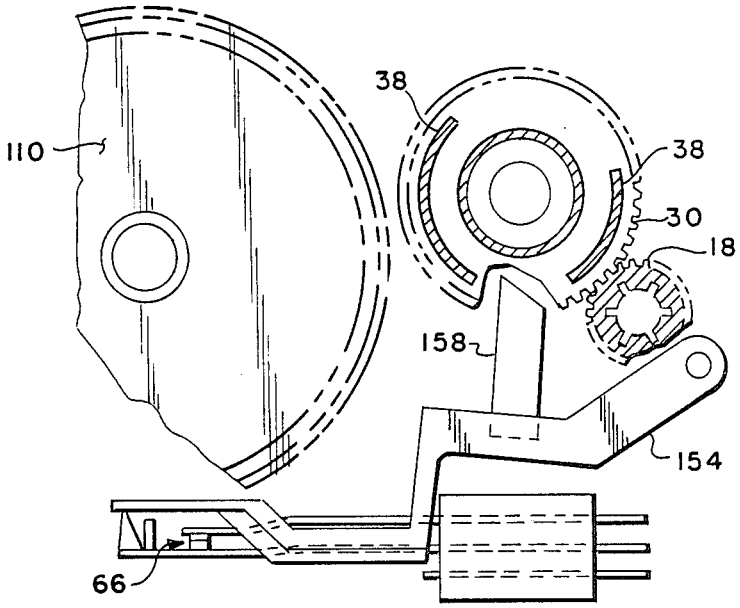
FIG. 6 is a partial section view taken along section indicating lines 6—6 of FIG. 5.
Figure 4:
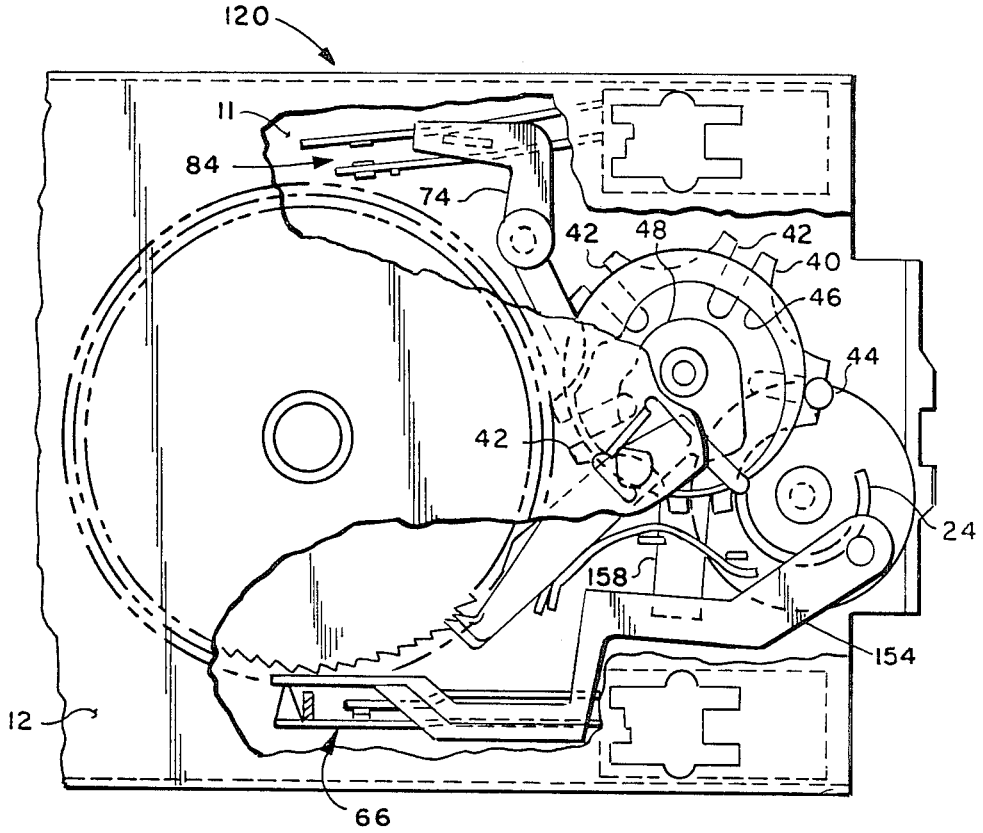
FIG. 4 is a partial side elevation view similar to FIG. 1 illustratig an alternate embodiment of the invention.
Figure 5:
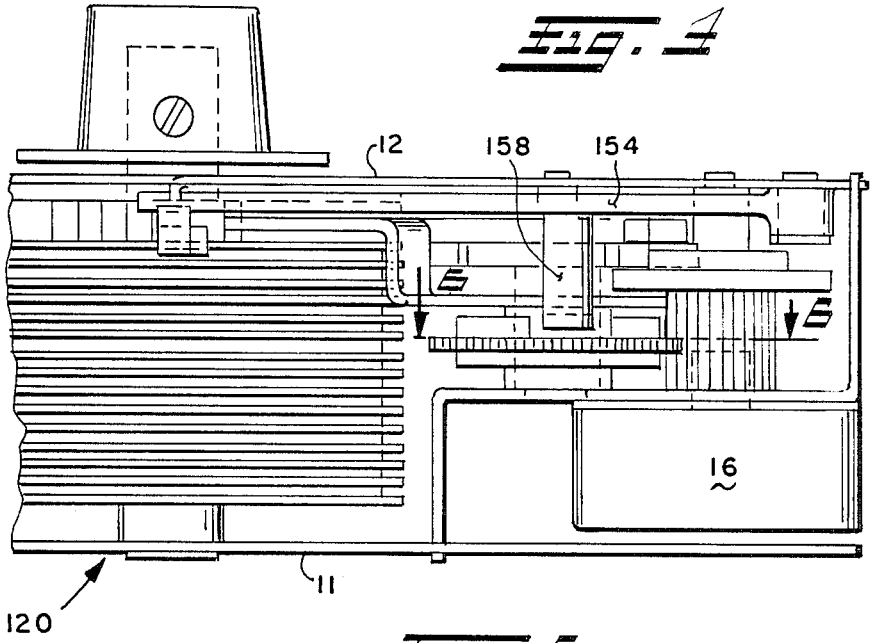
FIG. 5 is a bottom view of the embodiment of FIG. 4.

Referring now to FIGS. 4, 5 and 6, and alternate embodiment of the invention is indicated generally at 120 and has a construction similar to that of the embodiment 10 of FIG. 1 and for which identical parts have been denoted by the same reference numeral as the FIG. 1 embodiment. The embodiment 120 of FIG. 4 differs from the embodiment of FIG. 1 only in that the first sub-interval lever denoted 154 has the cam follower portion thereof denoted 158 configured and disposed so as to make contact with cam track 38 on secondary gear wheel 30 as shown in FIG. 6. Thus, the lever 154 is operative to provide continuous cyclic actuation and de-actuation of the switch 66 and response to rotation of gear wheel 30 by primary pinion gear 18. Thus, in the embodiment 120 of FIG. 4, both the sub-interval lever 74 and the sub-interval 154 are operated for continuous actuation and de-actuation of second and first sub-internal switches 84, 66, respectively, by the continuous rotation of cam track 38. It will be understood that the lever 74 has been omitted from FIG. 6 for clarity of illustration.

The present invention thus provides a unique and novel programmer/timer having a single constant rate rotation timing motor drive which powers a Geneva mechanism for intermittent rotation and has a first sub-interval cam intermittently driven with the Geneva wheel for actuating a first sub-interval switch on an intermittent basis. A secondary gear with an attached cam track is provided for continuously operating a second sub-interval cam lever and accompanying second sub-interval switch. An alternate embodiment of the invention employs a lever mechanism for the first sub-interval switch which also follows the continuously rotated cam track on the secondary gear by providing continuous actuation and de-actuation of both the first and second sub-interval switches.

Although the invention has hereinabove been described in respect to the illustrated embodiments, it will be understood by those having ordinary skill in the art that the invention is capable of modification and variation and is limited only by the scope of the following claims.

What is claimed is:

1. An electrical switch programmer driven by a rotary drive source, said programmer comprising:

a first gear member mounted for rotation on a frame and operable to be uniformly rotated at a substantially constant rate by the drive source;

a driven member mounted for rotation on the frame and operable to be rotated intermittently by said first gear member and including a first sub-interval cam means noted intermittently therewith;

a first sub-interval switch lever pivotally mounted on the frame and biased against the first cam means, said lever operative to actuate and deactuate first sub-interval electrical switch means in response to the intermittent rotation of said first cam means;

a second gear member mounted for rotation on the frame and operable to be rotated uniformly by the first gear member;

second sub-interval cam means mounted for rotation on the frame and operative to be rotated uniformly by said second gear member;

a second sub-interval switch lever pivotally mounted on the frame and biased against the second cam means, said lever operative to actuate and deactuate a second electrical switch means in response to the uniform rotation of the second sub-interval cam means;

third cam means connected for intermittent rotation with said driven member;

advance pawl means operative to be advanced by said third cam means; and, main cam means operable to be advanced step-by-step by movement of said advance pawl means and for sequentially actuating a plurality of program switches.

2. The programmer of claim 1 wherein said second gear member and intermittent drive member are mounted for rotation about a common axis.

3. The programmer of claim 1 wherein the second cam means and the intermittent driven member are fixedly secured to a common shaft mounted for rotation on the frame.

4. The programmer of claim 1 wherein said first gear member includes a disc having an eccentrically located pin extending therefrom and the driven member comprises a disc having a plurality of spaced-apart radially extending slots therein that are sequentially engagable with the pin in a manner enabling uniform rotation of the pin to impart intermittent rotation to the intermittent driven member.

5. An electrical programmer of the type adapted to be driven by a timing motor and speed reducer for use with an appliance comprising:

(a) frame means;

(b) primary gear means mounted for rotation on said frame means and driven at a substantially constant rate of rotation by said speed reducer;

(c) program cam means mounted for rotation on said frame means and including advance ratchet means, said program cam means sequentially actuating a plurality of program switches;

(d) pawl means operatively driven by said speed reducer and engaging said ratchet means for effecting step-by-step advancement of said program cam means;

(e) secondary gear means mounted for rotation on said frame means and operably engaging said primary gear means for substantially constant rate rotation thereby;

(f) first sub-interval cam means operably rotated at a substantially constant rate by said second gear means;

(g) first sub-interval switch means including cam follower means following said first sub-interval cam means and operable to open and close a first set of electrical contacts upon said constant rate advancement of said first sub-interval cam means;

(h) driven means mounted for rotation with respect to said frame means and operably connected by lost-motion connection to said secondary gear means for intermittent rotation upon said constant rate rotation of said first gear means;

(i) second sub-interval cam means mounted for rotation with respect to said frame means and operably connected for advancement by said intermittent rotation of said driven means; and, (j) second sub-interval switch means including cam follower means following said second sub-interval cam means intermittent advancement and operable in response thereto to open and close a second set of electrical contacts.

6. The programmer defined in claim 5, wherein said primary gear means comprises a single gear wheel engaging said secondary gear means.

7. The programmer defined in claim 5, wherein said lost motion connection comprises a wheel member having spaced radially extending slots intermittently engaging a lug on said primary gear means.

8. The programmer defined in claim 5, wherein said secondary gear means and said first sub-interval cam means are mounted for rotation about a common axis.

9. The programmer defined in claim 5, wherein said pawl means is driven by a cam means rotating about a common axis with said secondary gear means.

* * * * *